US006405471B1

(12) United States Patent
Mauch

(10) Patent No.: US 6,405,471 B1
(45) Date of Patent: Jun. 18, 2002

(54) SAFETY LOCK FOR AN AUTOMATIC WEAPON

(76) Inventor: Ernst Mauch, Gartenstrasse 10, 78655 Dunningen (DE)

( * ) Notice: Subject to any disclaimer, the term of this patent is extended or adjusted under 35 U.S.C. 154(b) by 0 days.

(21) Appl. No.: 09/419,036

(22) Filed: Oct. 15, 1999

Related U.S. Application Data

(60) Provisional application No. 60/134,456, filed on May 17, 1999.

(30) Foreign Application Priority Data

Dec. 11, 1998 (DE) ..... 198 57 319

(51) Int. Cl.[7] ..... F41A 17/02

(52) U.S. Cl. ..... 42/70.11; 42/66; 42/70.08; 42/70.01; 89/137

(58) Field of Search ..... 42/70.08, 70.01, 42/70.11, 66; 89/137

(56) References Cited

U.S. PATENT DOCUMENTS

| | | | | | |
|---|---|---|---|---|---|
| 875,469 | A | * | 12/1907 | Tambour | |
| 905,020 | A | * | 11/1908 | Tambour | |
| 2,945,316 | A | | 7/1960 | Mulno | 42/66 |
| 4,067,132 | A | * | 1/1978 | Smith | 42/66 |
| 4,135,320 | A | * | 1/1979 | Smith | 42/70 R |
| 4,154,014 | A | * | 5/1979 | Smith | 42/70 R |
| 4,467,545 | A | | 8/1984 | Shaw, Jr. | 42/70 |
| 4,672,763 | A | * | 6/1987 | Cunningham | 42/70.11 |
| 4,682,435 | A | * | 7/1987 | Heltzel | 42/70.01 |
| 4,730,537 | A | * | 3/1988 | Matzagg et al. | 89/148 |
| 4,833,811 | A | * | 5/1989 | Wilkinson | 42/70.08 |
| 4,845,870 | A | * | 7/1989 | Vernon | 42/70.08 |
| 4,967,502 | A | * | 11/1990 | Vernon | 42/70.08 |
| 5,081,779 | A | | 1/1992 | Pack | 42/70.11 |
| 5,225,612 | A | | 7/1993 | Bernkrant | 42/70.02 |
| 5,235,763 | A | | 8/1993 | Nosler et al. | 42/70.11 |
| 5,361,525 | A | * | 11/1994 | Bowes | 42/70.11 |
| 5,570,527 | A | * | 11/1996 | Felicci | |
| 5,910,003 | A | * | 6/1999 | Kleinpaul | |
| 6,269,576 | B1 | * | 8/2001 | Williams | |
| 6,283,006 | B1 | * | 9/2001 | Szabo et al. | |

FOREIGN PATENT DOCUMENTS

DE 39 37 042 C2 7/1994

OTHER PUBLICATIONS

PCT International Search Report dated Apr. 3, 2000 regarding PCT Patent Application Serial No. PCT/EP99/09787, 7 pages.

* cited by examiner

*Primary Examiner*—Michael J. Carone
*Assistant Examiner*—John Richardson
(74) *Attorney, Agent, or Firm*—Marshall, Gerstein & Borun

(57) ABSTRACT

A safety lock is disclosed for use with an automatic weapon such as a pistol. The automatic weapon has a hammer which is connected to a spring guide rod on which a striker spring is supported. This rod enters a removable insert during cocking of the hammer. A detent is arranged in the insert. The detent is preferably releasable and designed to prevent entry of the spring guide rod into the insert. The insert is replaceable with an ordinary insert and can accept a lock or a magazine safety or can be designed as an unreleasable detent.

63 Claims, 5 Drawing Sheets

FIG. 13
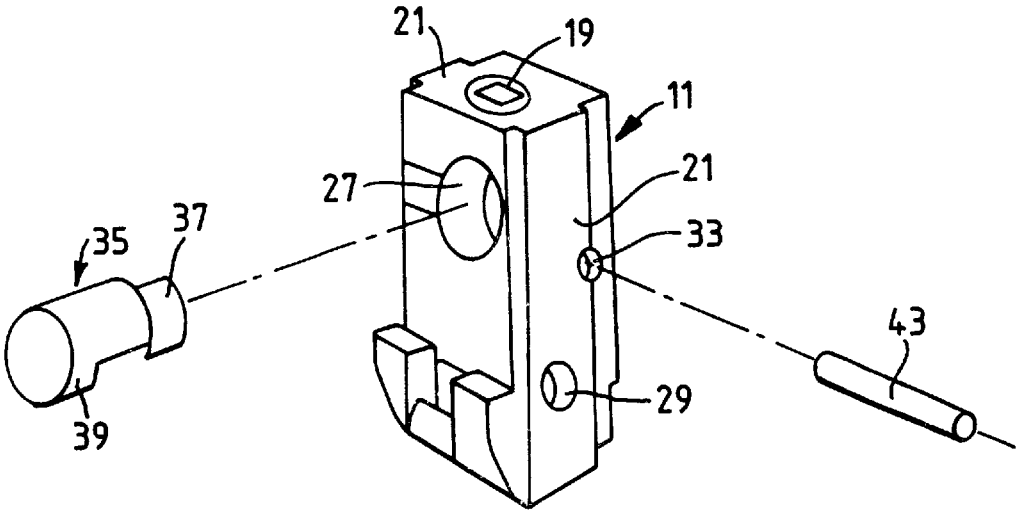
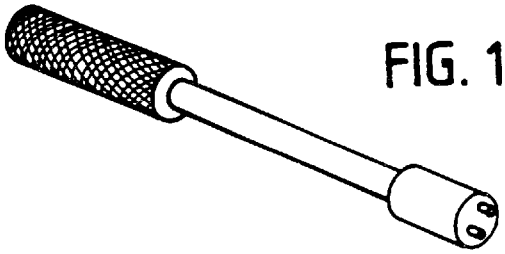
FIG. 14
FIG. 15
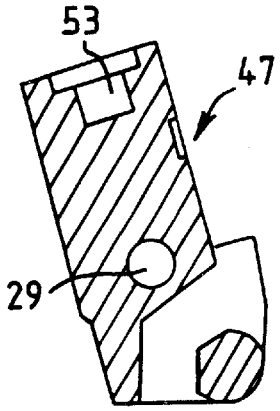
FIG. 16
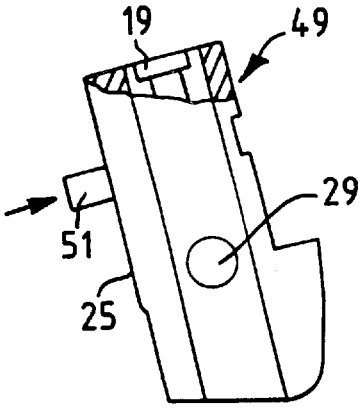

SAFETY LOCK FOR AN AUTOMATIC WEAPON

RELATED APPLICATION

This patent claims priority from U.S. Provisional Application Serial No. 60/134,456 which was filed on May 17, 1999.

FIELD OF THE INVENTION

The invention relates generally to firearms, and, more particularly, to safety locks for automatic weapons such as handguns.

BACKGROUND OF THE INVENTION

Automatic pistols having a removable magazine, a hammer, a rod movable with the hammer, and an insert mounted in the pistol stock and defining a recess receiving the free end of the movable rod have been known since the beginning of the century (see, for example, the Colt Model 1911). These prior art inserts do not interfere with the reciprocating movements (i.e., the cocking and uncocking movements) of the rod and hammer. An insert of the noted type is also already known in principle from the Browning Model 1903. In the Browning weapon, the insert permits the components that form a blind shaft which accepts the striker pin on the back side of the pistol stock to be machined and assembled separately. This approach was necessary in the Browning weapon since, unlike the shaft which accepts the magazine, the blind shaft could not be produced by broaching. This manufacturing problem (i.e., the inability to use broaching to form the blind shaft) no longer exists in many modern automatic pistols, since the pistol stock of a modern pistol is usually mass produced from plastic in one piece in an injection molding process. However, despite this advance, the insert has generally been retained in modern pistols since it forms the stop for the striker spring.

When using such an insert, it is possible to assemble the advance mechanism of the weapon without it being loaded by the striker spring during assembly. Instead, the insert is incorporated into the pistol after the advance mechanism is assembled. Since the striker spring is supported on the insert, locating the insert within the weapon, places the spring under tension.

In the interest of reliability, a simple design is always preferred in military weapons. However, civilian customers often desire more far-reaching safety features than military customers. It is, therefore, generally necessary to design and manufacture a civilian version of a weapon independently of mass production of military weapons. This necessity naturally increases the expense of manufacturing civilian weapons. Moreover, additional safety mechanisms for military weapons are also often subsequently required by customers. An effort is, therefore, made to find safety devices that permit simple equipping, and especially retrofitting, of a weapon that did not previously have such a safety device. One such safety device is a lock to prevent unauthorized use of the weapon.

Small arms which are used, for example, for game protection, self defense or the like, should be unloaded when they are not carried and reliably protected from unauthorized access. However, some individuals sometimes exhibit an undesirable casualness by storing the loaded weapon in a weapons cabinet that, in some circumstances, is deficiently secured. While it is common to store an automatic pistol by removing the magazine and placing it next to the weapon, some individuals instead put the loaded weapon safely away, (e.g., in a drawer or on a shelf). When such undesirable approaches to weapons storage are employed, it is possible that the loaded weapon can fall into the hands of unauthorized persons. Such unauthorized persons include children, who can threaten themselves and others with the weapon, and burglars, who can use the weapon during their burglary or even later. Other persons, (for example, household employees), who gain knowledge of the location of the weapon during safekeeping, can also steal it, perhaps to commit a crime.

A revolver is known (Bock-Weigel, Handbook of Small Arms, 1989, page 130) that attempts to remedy the above problem. In this revolver a keyed lock is inserted into the bottom stem of the pistol stock. When the hammer is uncocked, the lock can block a rod connected to the hammer (the guide rod for the striker spring), so that the hammer can no longer be cocked. The pistol then cannot be fired. Although this known revolver is certainly not secure against removal, it is secure against unauthorized use. The (quite small) key for this lock can be worn by the owner of the weapon, perhaps on a chain around the neck, where it is inaccessible to unauthorized persons.

However, the lock of this known weapon can be opened or circumvented quite easily. Because of its limited design dimensions and the required robustness (the recoil during firing must not adversely affect the function of the lock), the key is not designed to open tumblers. Instead, the key is not much more than an ordinary screwdriver for turning the lock. As a result, even without access to the key, the lock can be turned and, thus, opened, with an appropriate tool. Moreover, the handle escutcheons can be removed such that the lock can be accessed from the side and can be lifted out or otherwise made unusable. Finally, the lock can be frustrated by simply filing off the spring guide rod blocked by the lock when the handle escutcheons are removed. When the latter approach is employed, disorders can occur during cocking of the revolver, but when the weapon is first cocked, it can be fired without difficulty.

The lock described above is also disadvantageous in other respects. For example, since the lock is located on the bottom of the pistol stock, it is clearly visible and can be immediately recognized, even on cursory examination. It can then be disabled in one of the above mentioned ways in order to make the weapon ready for use.

Although the above noted revolver and lock is a reasonable approach to solving the aforementioned problem of. unauthorized access to a weapon, this design was not accepted by other manufacturers, but instead is merely a historical curiosity in the history of small arms. Presumably, the main reason why it did not gain acceptance was the ease with which the lock could be opened.

Another shortcoming of the aforementioned lock lies in the fact that the components to be rotated by means of the key have an axis of rotation that runs roughly across the direction of shooting. Therefore, the inertial forces occurring during firing run roughly tangentially to these components. Accordingly, the inertial forces attempt to rotate the rotatable components if they are unbalanced. If such a lock becomes slightly worn through, for example, long use or frequent manipulation, there is a risk that the lock will automatically lock after a shot is released. If this occurs, further use of the weapon will unexpectedly be prevented until the lock has been unlocked again.

The pistol stock in an automatic pistol is designed to accept a magazine. This magazine is typically quite wide, especially if it accepts large-caliber cartridges in a zigzag arrangement. It would, therefore, be obvious to use the space available in the pistol stock to accommodate a more effective lock, perhaps a safety lock with a closing cylinder. At least for children and untrained persons, such a lock would represent an obstacle that can scarcely be overcome. Moreover, the mounting of such a lock in the vicinity of the hammer makes filing off of the spring guide rod impossible. Reliable attachment of the lock in the frame also poses at least no fundamental difficulties. However, if this approach is taken, the pistol stock must then be redesigned. Both the safety lock and the necessary modifications to the weapon would be quite cost-intensive.

Moreover, although placing an enhanced lock in the stock of the pistol would frustrate unsophisticated users, the danger of use by a sophisticated unauthorized user would still not be eliminated as long as a person who manages to get his hands on the weapon that is secured by the lock can recognize at a glance that the weapon is secured and how it is secured. That person will then frustrate the lock, by, for example, routinely. drilling out the closing cylinder and releasing the lock.

The known proposal to arrange measurement sensors and electronics on a pistol that only permit use of the weapon when a certain hand line pattern is recognized is not feasible. Such an approach would even preclude the authorized user from using the weapon if the authorized user were wearing a glove, had a wound bandage on his/her hand, or if his/her hand were badly soiled.

Another known safety device is the so-called magazine safety which locks the weapon when the magazine is removed. Individuals often determine whether a weapon contains cartridges by briefly removing the magazine. If a visual inspection reveals the presence of one or more cartridges, the weapon is then put away or carried for actual use without further examination. A thorough functional test is generally not performed. Civilians sometimes remove the magazine when a pistol is put away, but then forget that a cartridge is present in the barrel thereby mistaking a loaded weapon for an unloaded weapon. Since a magazine safety precludes the weapon from firing when the magazine is removed even when a cartridge is left in the chamber, a magazine safety can prevent an accident from happening during handling of a pistol which is mistakenly believed to be unloaded.

Known magazine safety locks are usually connected to the trigger and advance mechanism. Such locks have a feeler that extends into the magazine shaft. This feeler activates the interrupter when the feeler is not pressed back by the introduced magazine. These magazine safety locks are, however, disadvantageous in that they increase the complexity of the weapons and, in so doing, necessarily reduce their reliability.

SUMMARY OF THE INVENTION

In accordance with an aspect of the invention, an automatic weapon having a stock is provided. The weapon includes a hammer, a magazine shaft for receiving a removable magazine, and a rod operatively coupled to, and movable with, the hammer. The rod extends into the stock such that an end of the rod is located within the stock. The weapon is further provided with an insert located within the stock, and a movable projection mounted within the insert. The projection has a first position wherein the projection performs at least one of preventing and substantially limiting movement of the hammer and a second position wherein the hammer is movable without interference from the projection.

In accordance with another aspect of the invention, a kit is provided. The kit includes an automatic pistol having a stock and a first insert for insertion into the stock of the pistol. The first insert includes a lock having a first condition wherein the lock prevents the pistol from being fired when the first insert is disposed in the pistol. The lock also has a second condition wherein the lock permits firing of the pistol when the first insert is disposed in the pistol. The kit is further provided with a second insert for insertion into the stock of the pistol. The second insert precludes firing of the pistol when the second insert is disposed in the pistol.

In accordance with yet another aspect of the invention, a lock is provided for use with an automatic weapon having a stock, a hammer, a magazine shaft for receiving a removable magazine, and a rod operatively coupled to, and movable with, the hammer and having an end located within the stock. The lock comprises an insert located within the stock, and a movable projection mounted within the insert. The projection has a first position wherein the projection performs at least one of preventing and substantially limiting movement of the hammer and a second position wherein the hammer is movable without interference from the projection.

In accordance with still another aspect of the invention, an automatic weapon having a stock is provided. The automatic weapon includes a hammer, a magazine shaft for receiving a removable magazine, and a rod operatively coupled to, and movable with, the hammer. The rod extends into the stock such that an end of the rod is located within the stock. The weapon also includes an insert located within the stock, and a blind hole defined in the insert and sized to receive the end of the rod to prevent downward movement of the rod to thereby prevent discharge of the pistol.

Other features and advantages are inherent in the disclosed apparatus or will become apparent to those skilled in the art from the following detailed description and its accompanying drawings.

BRIEF DESCRIPTION OF THE DRAWINGS

FIG. 13 is a perspective view of the insert, closure element and spring pin.

FIG. 14 is a perspective view of an exemplary key for the illustrated safety lock.

FIG. 15 is a cross-sectional view similar to FIG. 7, but through an alternative insert with an unreleasable detent.

FIG. 16 is a side view of another alternative insert including a magazine safety.

DESCRIPTION OF THE PREFERRED EMBODIMENTS

Throughout the drawings and the following description, the same reference numbers denote the same components.

Figure 1:
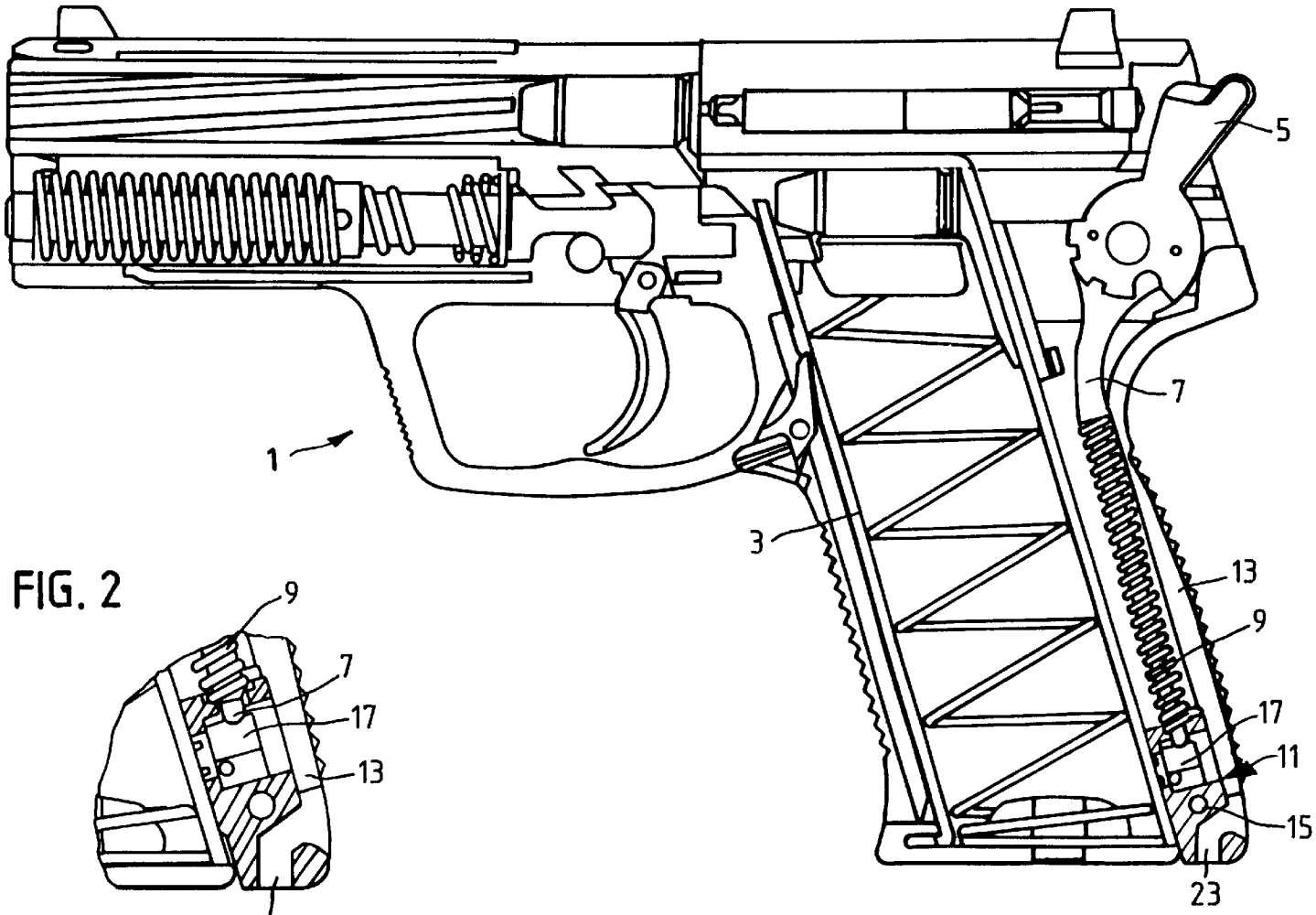
FIG. 1 is a longitudinal cross-sectional view of an automatic pistol equipped with a safety lock constructed in accordance with the teachings of the instant invention.

FIG. 1 illustrates, in longitudinal cross-section, an automatic pistol 1 constructed in accordance with the teachings of the invention. This pistol 1 has, in the usual manner, a magazine 3 which is introduced to a magazine shaft formed in a pistol stock 13.

A hammer 5 is mounted to pivot in pistol stock 13. A rod 7 acts from below on the hammer 5. The rod 7 is loaded upward by a striker spring 9. The striker spring 9 is designed as a coiled spiral spring and is mounted on the rod 7. The upper end of the spring 9 abuts an upper widening of the rod 7. The lower end of the spring 9 abuts an insert 11. The lower end of the rod 7 is preferably square and sits in a square blind hole 19 (see FIGS. 3, 4, 5, 7 & 8) which extends downward into the insert 11 and is open on the top.

A lock 17 is formed in the insert 11. The lock 17 can assume two positions, namely, a blocking or locking position, in which it blocks the square hole 19, and a release position, in which it does not block the square hole 19.

Figure 2:
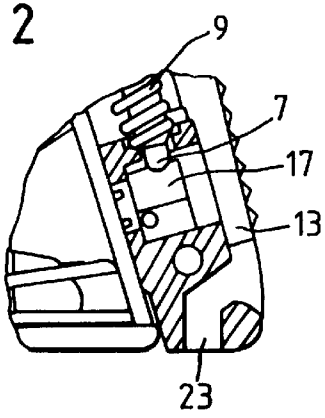
FIG. 2 is an enlarged detail of a portion of FIG. 1 showing the modified insert for the safety lock.
Figure 3:
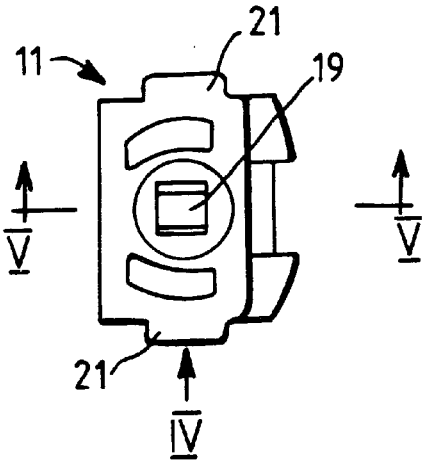
FIG. 3 is a top view of the insert of FIG. 2 viewed in the direction of the spring guide rod.

The hammer 5 is shown in FIG. 1 in the uncocked position. The rod 7 is pushed upward by the striker spring 9. When the hammer 5 is uncocked, the lower end of the rod only penetrates slightly into the square hole 19 (see also FIG. 2). If the hammer 5 is cocked, (i.e., pivoted in the view of FIG. 1 by about 60° clockwise), then it presses rod 7 downward against the force of the striker spring 9, and the square end of the rod 7 penetrates farther down into the square hole 19. If the hammer 5 is uncocked and the lock 17 is in the locking position, the lock 17 blocks the square hole 19 so that the square end of the rod 7 presses against the lock 17 and the rod 7 cannot be moved downward. Consequently, the hammer 5 is blocked in the position shown in FIG. 1 and this, in turn, blocks the slide (no reference number) of the pistol 1, so that the pistol 1 cannot be cocked or disassembled.

If, on the other hand, the lock 17 is in the release position, it does not block the square hole 19 and the square end of the rod 7 can, therefore, enter the square hole 19 unhampered when the hammer 5 is cocked. In other words, when the lock 17 is in the release position, the pistol is capable of use.

To secure the insert 11 within the pistol stock 13, the insert 11 has a transverse hole 29 beneath the end of the square blind hole 19. The transverse hole 29 can be brought into flush alignment with a transverse hole of the same diameter formed in the pistol stock 13. A pin 15 passes through both transverse holes, and sits with transition fit or with slight press-fit in the transverse hole of the pistol stock 13. The part of the pin 15 penetrating the insert 11 (i.e., its center section), however, is offset relative to its ends and has a smaller diameter.

During assembly, the insert 11 is pressed into the pistol stock 13 against the force of striker spring 9 until the two mentioned transverse holes are precisely aligned. The pin 15 is then pushed into the holes. If the insert 11 is then released, the striker spring 9 forces the insert 11 downward and outward again until the wall of the transverse hole 29 sits on the section of the pin 15 with a reduced diameter. In other words, the insert 11 moves downward slightly relative to the stock 13 such that the transverse holes in the stock 13 and insert 11 are no longer exactly aligned. As a result, if an attempt is made to push the pin 15 out again, the surface between the widened end and the narrowed section of the pin 15 strikes the side surface of the insert 11 on the edge of the transverse hole 29. In short, once inserted, the pin 15 can only be forced out again if the insert 11 is forced upward into the pistol stock 13 against the force of the striker spring 9 such that the transverse holes are precisely aligned.

Removal and insertion of the insert 11 can, thus, be carried out effortlessly arid quickly, but only when one knows how this operation is to be performed. It is not possible to simply knock out the pin 15; at least not without causing serious damage to the weapon.

Figure 4:
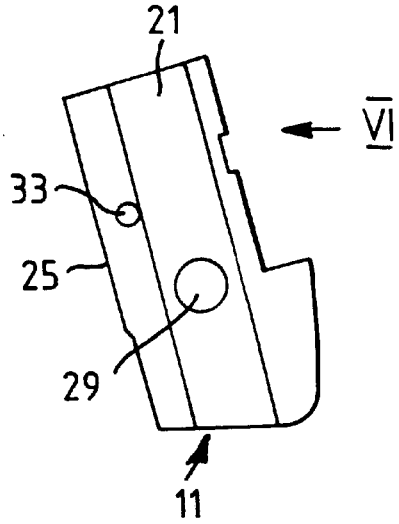
FIG. 4 is a side view of the insert viewed in the direction of arrow IV in FIG.3.
Figure 5:
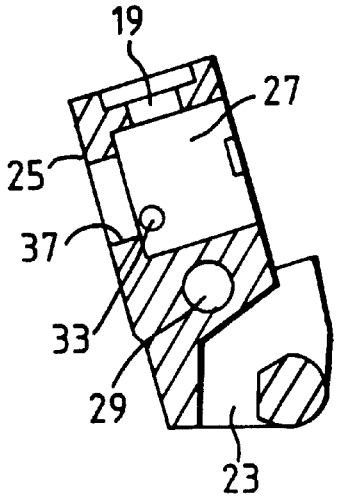
FIG. 5 is a cross-sectional view of the insert taken along line V—V of FIG. 3.
Figure 6:
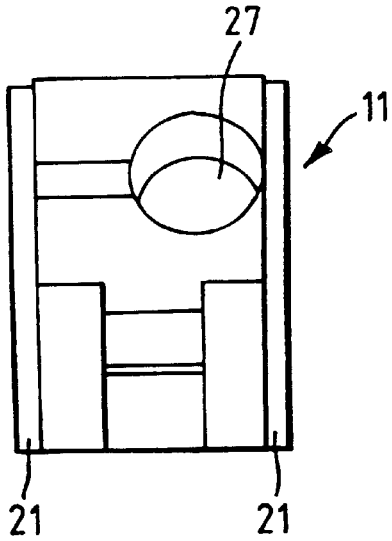
FIG. 6 is a back view of the insert viewed in the direction of arrow VI in FIG. 4.

In order to locate the insert 11 within the stock 13, guide pieces 21 are located on opposite sides of the insert 11 (FIGS. 4 and 6). These guides 21 are pushed into complementary grooves which are formed in the pistol stock 13 and, together with pin 15, secure the insert 11 within the stock 13. The front surface 25 of the insert 11 forms a wall adjacent the lower end of the magazine shaft. The lower end of the insert 11 is designed as a stub or belt eyelet 23.

The pistol stock 13 is manufactured in one piece from a highly loadable, impact-resistant plastic. The insert 11 is also made of this material.

Apart from the lock 17, the above description of the pistol 1 and the insert 11 corresponds to the prior art.

Figure 7:
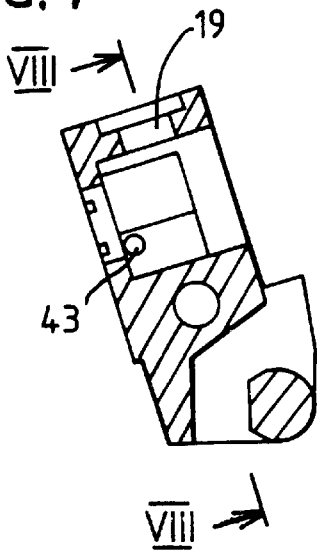
FIG. 7 is a view similar to FIG. 5, but showing the lock mounted within the insert.
Figure 8:
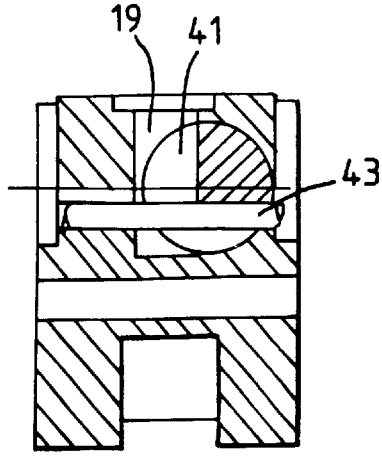
FIG. 8 is a cross-sectional view of the Insert taken along line VII—VIII of FIG. 7.
Figure 9:
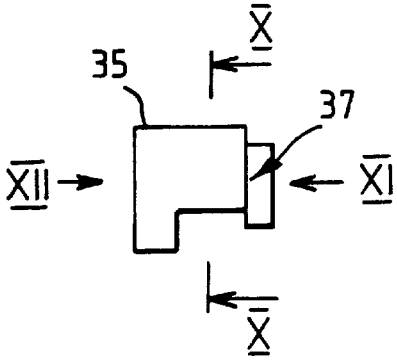
FIG. 9 is a side view of the closure element or detent of the lock of FIG. 1.
Figure 10:
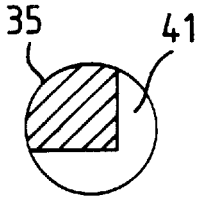
FIG. 10 is a cross-sectional view of the closure element or detent taken along line X—X of FIG. 9.

A first insert 11 constructed in accordance with the teachings of the invention will now described with reference to FIGS. 3 to 14. As most easily seen in FIG. 5 the insert 11 has a receiving hole or receiving chamber 27. This receiving chamber 27 serves to accept the lock 17. As most easily seen in FIGS. 6 and 8, the receiving chamber 27 is displaced laterally relative to the square hole 19. A narrowed neck or lateral bore 31 is formed in the front surface 25 of the insert and is in communication with the chamber 27. The lateral bore or neck 31 and the receiving hole 27 are coaxial and both are cylindrical. A snap-in hole or transverse bore 33 runs parallel to the transverse hole 29. The snap-in hole 33 has a distinctly smaller diameter than the transverse hole 29. The snap-in hole 33 intersects the receiving chamber 27 off center and near the neck 31 (FIG. 8).

The lock 17 is formed by a detent comprising a cylindrical snap-in body or block 35 and a coaxial, cylindrical neck piece 37. Although both are cylindrical, the neck piece 37 has a smaller diameter than the body 35. The snap-in block 35 fits rotatably within the receiving hole 27. The neck piece 37 fits rotatably within the lateral bore 31. When assembled, the radial end surface of the neck piece 37 is flush with the front surface 25 of the insert 11 and the radial end surface of the snap-in block 35 is flush with the rear surface of the insert 11.

The detent has a radial depression 41 located adjacent the neck piece 37. The radial depression 41 is bounded by two rectangular surfaces formed in the snap-in block 35 (see FIG. 10). These rectangular surfaces are substantially perpendicular to one another and form an apex therebetween. The surfaces lie beneath the square hole 19 after insertion of the snap-in block 35 into the insert 11. As shown in FIG. 7, the axis of the insert 11 runs perpendicular to the axis of the snap-in block 35.

The snap-in hole 33 is penetrated by a spring pin 43. The spring pin 43 lies under slight pretension against one of the rectangular surfaces of the detent. If the snap-in block 35 is rotated, the apex formed between the two rectangular surfaces runs above the spring pin 43 in its longitudinal direction. As a result, the pin 43 is initially elastically bent by the moving apex, and then the spring pin 43 reenters its released (although partially pretensioned) state against one of the rectangular surfaces. In other words, the surfaces, the apex and the spring 43 form a bistable lock.

In the locking position of the snap-in block 35 (position of FIG. 7), the peripheral surface of the snap-in block 35 opposite depression 41 closes the square hole 19 so that the rod 7 cannot enter the square hole 19. In the opposite position (FIG. 8), the square hole 19 is not blocked. FIG. 8 shows section VIII—VIII in FIG. 7, but the lock 17 is situated in the locking position in FIG. 7, and in the released position in FIG. 8.

Figure 11:
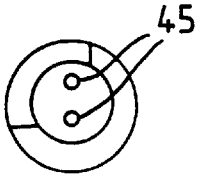
FIG. 11 is a front view of the closure element or detent viewed in the direction of arrow XI in FIG. 9.
Figure 12:
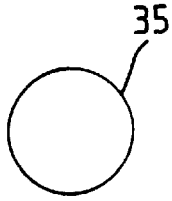
FIG. 12 is a back view of the closure element or detent viewed in the direction of arrow XII in FIG. 9.

To facilitate manipulation of the lock 17, the free end surface of the neck piece 37 has two engagement blind holes 45 (FIG. 11). The blind holes 45 are positioned opposite each other with the same radial spacing. Counterpieces on the end of a tool (FIG. 14) can engage in these holes 45 to adjust the position of the lock 17 between the locked and unlocked or released positions.

If one removes the magazine 3 from the pistol 1 depicted in FIG. 1, the extension of the axis of rotation of the snap-in block 35 and the neck piece 37 then passes just beneath the extension of the front and lower end edge of the magazine shaft. If the engagement pins of the tool depicted in FIG. 14 are introduced into the engagement holes 45 of the neck piece 37 of the lock 17, the center axis of the tool runs coaxially to both the snap-in block 35 and the neck piece 37. As a result, the tool lies against the front lower edge of the pistol stock 13 and is guided by this engagement. The snap-in block 35 is switched between its two positions (i.e., the lock 17 is switched between its locking position and its release position) by rotating the tool. Spring pin 43 ensures proper securement of the detent 35, so that the lock 17 cannot leave the release position, for example, during a shot as a result of shaking of the weapon. The cooperation of the components of the lock can best be gleaned from the exploded view of FIG. 13.

FIG. 15 shows another insert (designated with reference number 47) constructed in accordance with the teachings of the invention. Insert 47 has only a very short blind hole 53 (instead of the square hole 19 of insert 11). If this insert 47 is used in the pistol 1 instead of a generic, prior art insert, then the rod 7 sits with its lower end in the short blind hole 53. The blind hole 53 centers the rod 7, but does not permit downward movement of the rod 7. Therefore, insert 47 prevents the hammer 5 from being cocked and, thus, precludes use of the weapon 1. This insert 47 is used during storage, shipment or display of the pistol 1. If the pistol 1 is sold, issued to a soldier or policeman, etc., and it is desired to make the pistol ready for use, the insert 47 is removed in the aforementioned manner (i.e., by pushing the insert 47 upward against the force of the striker spring 9 to align the transverse hole 29 of the insert with the transverse hole in the stock 13, and then pushing pin 15 out of the holes), and replaced by an ordinary prior art insert or one of the other inserts 11, 49 disclosed herein.

FIG. 16 illustrates another insert 49 constructed in accordance with the teachings of the invention. This insert 49 has a feeler 51, which is forced into the magazine shaft by a spring 60 (see FIG. 17). The feeler 51 defines a shoulder 62 which cooperates with the front wall 25 of the insert 49 to limit movement of the feeler 51 in the direction opposite the arrow in FIG. 16. If a magazine 3 is introduced into the magazine shaft, it lies against the front surface 25 of the insert 49 and forces the feeler 51 in the direction of the arrow in FIG. 16 into the insert 49 against the force of the spring 60. Persons of ordinary skill in the art will readily appreciate,that either the magazine or the feeler 51 can include a camming surface to facilitate displacement of the feeler 51 against the spring force upon insertion of the magazine 3.

Figure 17:
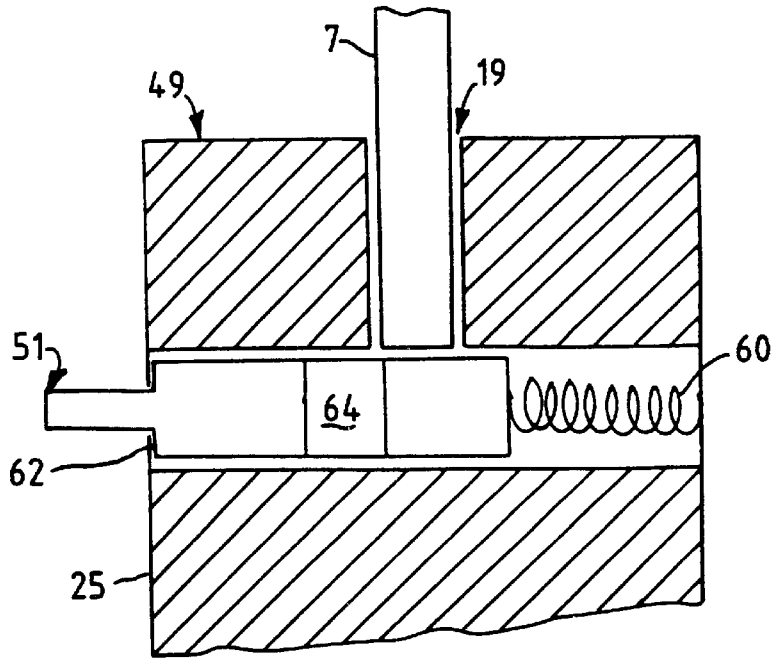
FIG. 17 is a partial schematic illustration in cross-section of the insert of FIG. 16.

The feeler 51 intersects, for example, the square hole 19. As shown in FIG. 17, the feeler 51 defines a notch 64. When, because no magazine is in the magazine shaft, the feeler 51 extends into the magazine shaft, the notch 64 is out of alignment with the hole 19 as shown in FIG. 17. However, when the feeler 51 is forced into the insert 49 by locating a magazine 3 in the magazine shaft, the notch 64 aligns with the hole 19. The rod 7 can then freely enter the notch 64. If the feeler 51 is in the position depicted in FIG. 16, (i.e., the magazine is removed), the shaft of the feeler 51 is adjacent the hole 19. As a result, the feeler 51 prevents movement of the rod 7 and, thus, cocking of the hammer 5.

Figure 18:
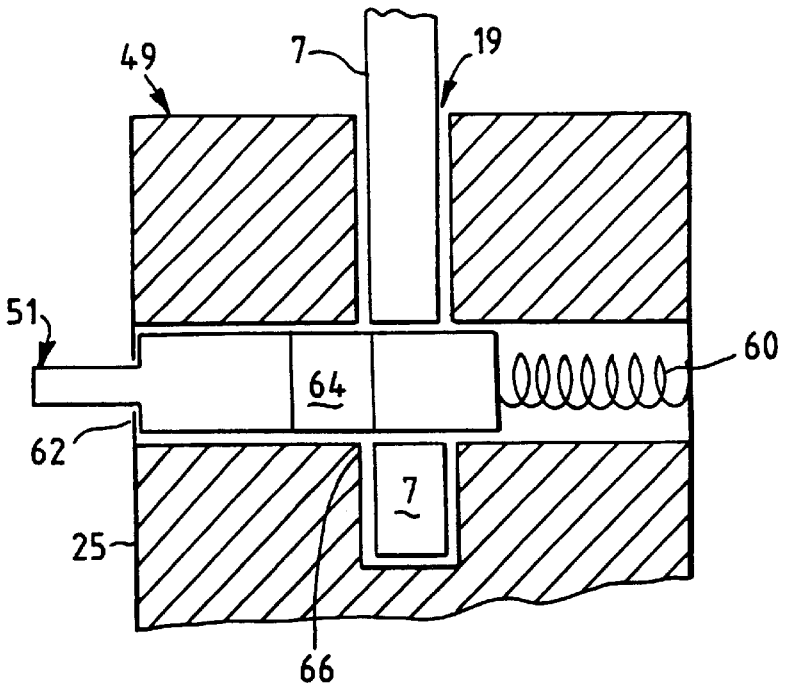
FIG. 18 is a partial schematic illustration in cross-section of a modified insert similar to that shown in FIGS. 16 and 17.

In the alternative embodiment shown in FIG. 18, the rod 7 may also be provided with a notch 66, through which the shaft of the feeler 51 can pass in blocking fashion when the hammer is cocked and the rod 7 is in its lowermost position. It is, therefore, possible to secure the pistol 1 when it is cocked by removing the magazine 3. In this condition (shown in FIG. 18), the hammer 5 cannot strike because the fixed rod 7 cannot move despite the force of the striker spring 9. Persons of ordinary skill in the art will further appreciate that, it is possible to provide the pistol 1 with a safety catch such that, if the hammer 5 is secured in the cocked position when a magazine 3 is introduced into the shaft, the hammer 5 will only fall into the safety catch and will not discharge a shot.

From the foregoing, persons of ordinary skill in the art will appreciate that a method for incorporating one of the above safety locks in an already existing design of an automatic weapon such as a pistol in simple fashion, even by retrofitting, has been disclosed. The method is implementable in a simple, robust and reliable manner.

The known revolver with lock described in the background section above, like the locks disclosed herein, also has a device to block the rod. But this device is incorporated in its own reinforced frame, and at a location that is generally reserved for the magazine in an automatic pistol.

On the other hand, in the locks disclosed herein, the projection for blocking the rod 7 is incorporated in an insert 11, 47, 49. Since, as described above, prior art pistols employed an insert without a lock to receive the free end of the rod, during assembly of the pistol it is only necessary to use an insert 11, 47, 49 constructed pursuant to the teachings of the invention instead of the prior art insert in order to create a pistol, which, unlike the prior art pistol, is capable of preventing cocking of the hammer 5 or, optionally, advance of the cocked hammer 5 (e.g., if the projection engages, say, in a notch 66 of the rod 7 (see FIG. 18)).

As discussed above, the insert 11 can have a releasable detent. Such a detent can be locked or released as required, preferably by means of a wrench-like tool. In such an approach, the automatic pistol 1 is equipped with a closable lock.

However, as also discussed above, the detent, which can be arranged in or formed by the insert, can also be unreleasable, so that the automatic pistol 1 can be made unusable by replacing an existing known insert with a detent insert 47. This possibility is important, say, for gun stores, which keep weapons in display windows. It can also be important for police and the military for safekeeping of stored weapons; and/or for transport of weapons. Should a store thief obtain a pistol 1 that includes a detent insert 47 from the display window, or should he attempt to take a weapon presented for inspection and escape with it, there is no hazard that he will load the weapon with carried ammunition and use it to make good his escape since, even when loaded, the weapon cannot be fired. In the police or military context, the personnel responsible for safekeeping of weapons cannot take a weapon employing the detent insert 47 in order to use it privately. Likewise, an employee of a transport company cannot misuse a weapon employing the detent insert 47 along the way for shooting practice. None of these misuses can occur, because the weapon is, indeed, properly assembled, but cannot fire. The inserts (11, 49 or a prior art insert) that permit functioning of the weapon must naturally be kept far away from the secured pistols, under lock and key. Replacement of the insert 47 and, thus, arming of the pistol 1 is a trivial matter, even for a layman, when he is shown how to perform the task and provided with the replacement part.

The detent 35 is preferably designed as a lock 17 in the broader sense. For this purpose, it has a lock 17 that engages in its locked position behind the rod 7 or engages in a notch 66 of the rod 7. Moreover, a wrench-like tool is provided for manipulating the lock. A closing cylinder is generally not provided, since it is too sensitive to the high loads to which it is exposed.

However, to hamper abusive use, the disclosed locks 17 take a completely different and unusual path, namely, concealing the locks 17 from the view of unauthorized persons. Since the lock 17 cannot even be seen, an unauthorized user is not likely to quickly manipulate the lock and the weapon is, thus, secured from unauthorized use. The engagement holes 45 of the lock 17 in which the key must be inserted for activation are preferably arranged so that the ignorant and unauthorized user does not recognize the presence of a detent 35. The unauthorized user will likely only discern that the pistol does not function when he attempts to use it. Moreover, there can be many reasons for this failure to function. Thus, the unauthorized user will probably not manipulate the lock 17, since he is not even aware of its presence. The aforementioned solution with the replaceable insert 47 that prevents firing also offers the same advantage.

It must be noted here that the applicant is expressly reserving its claim for separate protection for the invisible, perhaps concealed, application of the detent. Moreover, persons of ordinary skill in the art will appreciate that the teachings of the invention are in no way limited to automatic pistols, but also apply to hunting, sport and military weapons of all types. Persons of ordinary skill in the art will further appreciate that the detent 35 need not act merely on the rod, but can also act on any other element whose securing or moving is suitable for preventing use of the weapon without departing from the scope or spirit of the invention.

The subsequent modifications of this concealed application of the lock or detent should also acquire independent protection. Thus, for example, it is possible to provide a transversely running threaded hole in a sport weapon with a cylinder closure in the frame, in which an Allen screw that can be turned by means of an Allen wrench sits in a recess of the slightly opened closure. In the tightened state, the screw lies so deeply in the hole that it cannot be recognized from the exterior without difficulty. It then penetrates into a counterprojection, so that the closure is secured. If the screw is unscrewed again by means of the wrench, it is again visible from the outside and the closure is released, so that the weapon is ready for use.

In the disclosed weapon, a cover is provided to render the lock 17 invisible. In the case just described, the cover could be a screw with a short shaft, which is screwed into the hole in front of the stud screw.

As discussed above, an unauthorized user, who has gained access to an automatic pistol employing one of the disclosed locks and has convinced himself by checking the magazine of its usability, will only find that this use is not possible when he attempts to fire the weapon.

Even if an unauthorized user tests the weapon for use and then finds that it does not function, he will likely deem it defective and may attempt to take it apart. However, disassembly is generally not possible, since, with the uncocked hammer 5 fixed by the insert 11, the hammer is blocked against cocking and removal of the slide is prevented. Although this condition can be corrected by removing the insert 11, 47 49, he will not be prompted to act on the lock 17, since he cannot assume that such a lock exists. The possible existence of such a lock is, at best, familiar to the technical personnel of a gun shop or one skilled in the art of small arms. As a result, the weapon cannot be used by unauthorized individuals immediately or a short time after its removal from storage, theft, etc. As described above, this beneficial result is achieved with a simple, small and robust lock, which is much more cost-effective than an expensive safety lock. If children or adolescents have stolen the weapon, after discovery of the defect of the weapon, the limited group of people generally involved here will typically decide that the weapon can be returned before an accident has happened.

It is possible, in the simplest case, to arrange the lock 17 as in a revolver mentioned at the outset, but to recess it slightly so that it is accessible through a hole that can be closed by a plastic plug. This plastic plug can be adapted in color and design to the parts surrounding it, so that it is not easily recognized as a removable part. The plug must be removed, (perhaps with a fingernail), in order to provide access for the key for unlocking or locking. Several plugs can be provided at the time of sale of the weapon, so that, in the event of damage or loss, a replacement is still available. However, the problem of the possible effect of inertial forces on the lock 17 is still present. These can act on and displace a lock, when it is unbalanced and its axis runs across the direction of recoil.

The preferred embodiment disclosed herein addresses this issue by positioning the lock 17 such that the axis of rotation of the lock runs roughly parallel to the direction of firing of the weapon. Inertial forces that occur as a result of firing and are aligned parallel to the direction of firing therefore act in the axial direction of the rotatable parts of the lock 17 and are, thus, not capable of rotating these parts. Instead, these parts are pressed axially into their mount and are, thus, securely fixed during the action of the inertial forces.

The key in this case can be introduced from the back side of the pistol stock 13 after the cover provided there has been removed.

In a preferred embodiment the magazine 3 is the cover, (i.e., the engagement holes or projections provided for use of the key are arranged on the back side of the magazine shaft).

The bottom of the magazine 3 is generally beveled so that the front side of the magazine shaft lies higher than its back side. If the lock 17 is located in the lowermost section of the back side of the magazine shaft, a straight key can then conveniently reach the lock 17 when it is passed along the lower front edge of the magazine shaft. It is even advantageous to use the mentioned front edge of the shaft as a support, in order to introduce the key reliably into the keyholes 45 of the lock 17. Moreover, these keyholes 45 are then always protected from soiling and view, as in the case of a different cover.

In automatic pistols the magazine shaft is generally only limited rearward by guides; not by a closed wall. Therefore, the insert 11, 47, 49 forms, on the lower end, the guide and the walls of the magazine shaft. The insert 11, 47 49 is, therefore, freely accessible from the magazine shaft, but is not easily recognizable.

As described above, the insert can also comprise a magazine safety. In such an insert 49, a feeler 51, forced by a spring 60 into the empty magazine shaft, activates the detent. When a magazine 3 is introduced to the shaft, the feeler 51 is forced or pushed in by the magazine 3 and the detent is released. Thus, the pistol 1 cannot shoot after the magazine 3 has been removed, even if a cartridge is left in the chamber.

The outer dimensions of the different inserts (the prior art insert without additional function, the insert 47 with the permanent detent, the insert 11 with the releasable detent or lock, and the insert 49 with the magazine safety) are the same. All other relevant features (length of the spring guide rod 7, design and length of the striker spring 9, hole in the rear wall of the magazine shaft) are also preferably of the same design in all types of pistols (with or without lock, permanent detent, magazine safety), so that ultimately the insert 11, 47, 49 with lock or the like can also be furnished afterward as a retrofitting component for already existing pistols.

A kit, comprising a pistol 1 and at least two different inserts (e.g., two of the set comprising a prior art insert and the disclosed inserts 11, 47, 49, in any combination) is also disclosed. The kit may optionally include a box for shipment and/or sale of the kit.

While in the pistol 1 described herein, the rod 7 is preferably intended as a spring guide rod for the coiled striker spring 9, it is also possible, in other striker springs, to hinge the hammer 5 to a separate rod whose only purpose is to cooperate with the lock 17 without departing from the scope or spirit of the invention.

The pistol stock 13 itself is preferably designed in one piece, together with the handle escutcheons. By way of examples, not limitations, the stock 13 and escutcheons can be made of reinforced or unreinforced plastic. Under this approach, it is not possible to remove the handle escutcheons and act on the then recognizable lock 17.

Although certain examples constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. An automatic weapon having a stock comprising:

a hammer;

a magazine shaft for receiving a removable magazine;

a rod operatively coupled to, and movable with, the hammer, the rod extending into the stock such that an end of the rod is located within the stock;

an insert located within the stock;

a rotatable projection mounted within the insert and having a first position wherein the projection performs at least one of preventing and substantially limiting movement of the hammer and a second position wherein the hammer is movable without interference from the projection, the projection being accessible from within the magazine shaft; and a detachable tool sized to selectively engage the projection within the magazine shaft to rotate the projection between the first and second positions.

2. A weapon as defined in claim 1 wherein the insert defines a bore dimensioned to receive the end of the rod as the hammer and rod move to fire a cartridge.

3. A weapon as defined in claim 2 wherein the projection prevents movement of the rod when the projection is in the first position.

4. A weapon as defined in claim 2 wherein the projection comprises a detent.

5. A weapon as defined in claim 4, wherein:

(a) the insert further comprises:

a receiving chamber having a longitudinal axis;

an upper bore in communication with the receiving chamber and sized to receive the end of the rod; and a lateral bore in communication with the receiving chamber, the lateral bore having a longitudinal axis in substantial alignment with the longitudinal axis of the receiving chamber; and (b) wherein the detent further comprises:

a body sized to be rotatably received within the receiving chamber;

a neck piece sized to be rotatably received within the lateral bore; and a radial depression located adjacent the neck piece and defining two substantially perpendicular surfaces.

6. A weapon as defined in claim 5 further comprising a spring mounted within the insert to cooperate with the substantially perpendicular surfaces to define the first and second positions.

7. A weapon as defined in claim 6 wherein the insert further defines a transverse bore and the spring is mounted within the transverse bore.

8. A weapon as defined in claim 5 wherein the receiving chamber, the lateral bore, the body and the neck are substantially cylindrical.

9. A weapon as defined in claim 1 wherein the insert comprises a first insert and the weapon further comprises a second insert, wherein the second insert performs at least one of preventing and substantially limiting movement of the rod, and wherein the first and second inserts are interchangeable.

10. A weapon as defined in claim 9 wherein the first insert is removed from the weapon and the second insert is located in the stock of the weapon during shipment or extended periods of non-use of the weapon.

11. A weapon as defined in claim 9 wherein the second insert is removed from the weapon and the first insert is located in the stock of the weapon when the weapon is to be used.

12. A weapon as defined in claim 9 wherein the second insert includes a blind hole that performs at least one of preventing and substantially limiting movement of the rod.

13. A weapon as defined in claim 1 wherein the projection comprises a locking bar.

14. A weapon as defined in claim 13 wherein the locking bar secures the hammer in an uncocked position and precludes cocking of the hammer when the locking bar is in the first position.

15. A weapon as defined in claim 1 wherein the insert and the projection together comprise a lock, and the lock is mounted such that it is substantially hidden from view outside of the weapon.

16. A weapon as defined in claim 1 further comprising a removable cover for hiding the projection from view.

17. A weapon as defined in claim 16 wherein the magazine comprises the cover.

18. A weapon as defined in claim 1 wherein the projection comprises a locking bar, the locking bar is rotatable between the first and second positions, the locking bar has an axis of rotation, and the axis of rotation of the locking bar runs roughly parallel to a direction of firing of the weapon.

19. An automatic weapon having a stock comprising:

a hammer;

a magazine shaft for receiving a removable magazine;

a rod operatively coupled to, and movable with, the hammer, the rod extending into the stock such that an end of the rod is located within the stock;

an insert located within the stock; and a movable projection mounted within the insert and having a first position wherein the projection performs at least one of preventing and substantially limiting movement of the hammer and a second position wherein the hammer is movable without interference from the projection, wherein the projection comprises a feeler, the feeler projects into the magazine shaft when the feeler is in the first position, the feeler is biased toward the first position, and insertion of a magazine into the magazine shaft moves the feeler into the second position to thereby permit free movement of the rod.

20. A weapon as defined in claim 19 further comprising a spring disposed in the insert for biasing the feeler toward the first position.

21. A weapon as defined in claim 19 wherein the feeler defines a notch for receiving the rod.

22. A weapon as defined in claim 21 wherein the rod defines a notch for receiving the feeler.

23. A weapon as defined in claim 19 wherein the rod defines a notch for receiving the feeler.

24. A weapon as defined in claim 1 further comprising a striker spring.

25. A weapon as defined in claim 1 further comprising handle escutcheons, and wherein the stock is integrally formed with the handle escutcheons.

26. A kit comprising:

an automatic weapon having a stock;

a first insert for insertion into the stock of the weapon, the first insert including a lock having a first condition wherein the lock prevents the weapon from being fired when the first insert is disposed in the weapon, and the lock having a second condition wherein the lock permits firing of the weapon when the first insert is disposed in the weapon; and a second insert for insertion into the stock of the weapon, the second insert precluding firing of the weapon when the second insert is disposed in the weapon.

27. A kit as defined in claim 26 wherein:

(a) the weapon further comprises a rod operatively coupled to, and movable with, the hammer, the rod extending into the stock such that an end of the rod is located within the stock; and (b) the first insert further comprises a movable projection having a first position wherein the projection performs at least one of preventing and substantially limiting movement of the rod and a second position wherein the rod is movable without interference from the projection.

28. A kit as defined in claim 27 wherein:

(a) the projection comprises a detent;

(b) wherein the first insert further comprises:

a receiving chamber having a longitudinal axis;

an upper bore in communication with the receiving chamber and sized to receive the end of the rod; and a lateral bore in communication with the receiving chamber, the lateral bore having a longitudinal axis in substantial alignment with the longitudinal axis of the receiving chamber; and (c) wherein the detent further comprises:

a body sized to be rotatably received within the receiving chamber;

a neck piece sized to be rotatably received within the lateral bore; and a radial depression located adjacent the neck and defining two substantially perpendicular surfaces.

29. A kit as defined in claim 28 further comprising a spring mounted within the first insert to cooperate with the substantially perpendicular surfaces to define the first and second positions.

30. A kit as defined in claim 29 wherein the first insert further defines a transverse bore and the spring is mounted within the transverse bore.

31. A kit as defined in claim 28 wherein the receiving chamber, the lateral bore, the body and the neck are substantially cylindrical.

32. A kit as defined in claim 26 wherein the first insert is removed from the weapon and the second insert is located in the stock of the weapon during shipment or extended periods of non-use of the weapon.

33. A kit as defined in claim 26 wherein the second insert is removed from the weapon and the first insert is located in the stock of the weapon when the weapon is to be used.

34. A kit as defined in claim 26 wherein the second insert includes a blind hole that performs at least one of preventing and substantially limiting movement of the rod.

35. A kit as defined in claim 26 wherein the lock comprises a locking bar and the weapon further comprises a wrench-like tool, the wrench-like tool and the locking bar being dimensioned to cooperate to move the locking bar between the first and second positions.

36. A kit as defined in claim 27 wherein the projection comprises a feeler, the feeler projects into a magazine shaft of the weapon when the feeler is in the first position, the feeler is biased toward the first position, and insertion of a magazine into the magazine shaft moves the feeler into the second position to thereby permit free movement of the rod.

37. A weapon as defined in claim 36 further comprising a spring disposed in the insert for biasing the feeler toward the first position.

38. A weapon as defined in claim 36 wherein the feeler defines a notch for receiving the rod.

39. A weapon as defined in claim 38 wherein the rod defines a notch for receiving the feeler.

40. A weapon as defined in claim 36 wherein the rod defines a notch for receiving the feeler.

41. For use with an automatic weapon having a stock, a hammer, a magazine shaft for receiving a removable magazine, and a rod operatively coupled to, and movable with, the hammer and having an end located within the stock, a lock comprising:

an insert located within the stock;

a rotatable projection mounted within the insert and having a first position wherein the projection performs at least one of preventing and substantially limiting movement of the hammer and a second position wherein the hammer is movable without interference from the projection, the projection being accessible from within the magazine shaft only when no magazine is present within the magazine shaft; and a detachable tool sized to selectively engage the projection within the magazine shaft to rotate the projection between the first and second positions.

42. A lock as defined in claim 41 wherein:

(a) the projection comprises a detent;

(b) the first insert further comprises:

a receiving chamber having a longitudinal axis;

an upper bore in communication with the receiving chamber and sized to receive the end of the rod; and a lateral bore in communication with the receiving chamber, the lateral bore having a longitudinal axis in substantial alignment with the longitudinal axis of the receiving chamber; and (c) the detent further comprises:

a body sized to be rotatably received within the receiving chamber;

a neck piece sized to be rotatably received within the lateral bore; and a radial depression located adjacent the neck and defining two substantially perpendicular surfaces.

43. A weapon as defined in claim 41 wherein the insert defines a bore dimensioned to receive the end of the rod as the hammer and rod move to fire a cartridge.

44. A weapon as defined in claim 41 wherein the projection prevents movement of the rod when the projection is in the first position.

45. For use with an automatic weapon having a stock, a hammer, a magazine shaft for receiving a removable magazine, and a rod operatively coupled to, and movable with, the hammer and having an end located within the stock, a lock comprising:

an insert located within the stock; and a movable projection mounted within the insert and having a first position wherein the projection performs at least one of preventing and substantially limiting movement of the hammer and a second position wherein the hammer is movable without interference from the projection, wherein the projection comprises a feeler, the feeler projects into the magazine shaft of the weapon when the feeler is in the first position, the feeler is biased toward the first position, and insertion of a magazine into the magazine shaft moves the feeler into the second position to thereby permit free movement of the rod.

46. An automatic weapon having a stock comprising:

a hammer;

a magazine shaft for receiving a removable magazine;

a rod operatively coupled to, and movable with, the hammer, the rod extending into the stock such that an end of the rod is located within the stock;

an insert located within the stock; and a blind hole defined in the insert and sized to receive the end of the rod to prevent downward movement of the rod to thereby prevent discharge of the weapon such that the weapon cannot be fired unless the insert is removed from the stock.

47. An automatic weapon having a stock comprising:

a hammer;

a magazine shaft for receiving a removable magazine;

a rod operatively coupled to, and movable with, the hammer, the rod extending into the stock such that an end of the rod is located within the stock;

an insert located within the stock;

a movable projection mounted within the insert and having a first position wherein the projection performs at least one of preventing and substantially limiting movement of the hammer and a second position wherein the hammer is movable without interference from the projection, the projection comprises a locking body, the locking body has an axis, the axis runs substantially parallel to the direction of firing of the weapon, and the projection is accessible from within the magazine shaft; and a detachable tool adapted to selectively engage the projection within the magazine shaft to move the locking body between the first and second positions.

48. A weapon as defined in claim 47 wherein the axis is an axis of rotation and the locking body is rotatable about the axis.

49. A weapon as defined in claim 47 wherein the projection forms part of a lock.

50. A weapon as defined in claim 49 wherein the lock is mounted such that it is substantially hidden from view outside of the weapon.

51. A weapon as defined in claim 47 further comprising a removable cover for hiding the projection from view.

52. A weapon as defined in claim 51 wherein the magazine comprises the cover.

53. A weapon as defined in claim 47 further comprising a striker spring.

54. A weapon as defined in claim 47 further comprising handle escutcheons, and wherein the stock is integrally formed with the handle escutcheons.

55. An automatic weapon having a stock comprising:

a hammer;

a magazine shaft for receiving a removable magazine;

a rod operatively coupled to, and movable with, the hammer, the rod extending into the stock such that an end of the rod is located within the stock;

an insert located within the stock, the insert including: (1) a receiving chamber having a longitudinal axis, (2) an upper bore in communication with the receiving chamber and sized to receive the end of the rod, and (3) a lateral bore in communication with the receiving chamber, the lateral bore having a longitudinal axis in substantial alignment with the longitudinal axis of the receiving chamber;

a rotatable projection mounted within the insert and having a first position wherein the projection performs at least one of preventing and substantially limiting movement of the hammer and a second position wherein the hammer is movable without interference from the projection, the projection including: (1) a body sized to be rotatably received within the receiving chamber, (2) a neck piece sized to be rotatably received within the lateral bore, and (3) a radial depression located adjacent the neck piece and defining two substantially perpendicular surfaces; and a spring mounted within the insert to cooperate with the substantially perpendicular surfaces to define the first and second positions.

56. A weapon as defined in claim 55 wherein the insert further defines a transverse bore and the spring is mounted within the transverse bore.

57. An automatic weapon having a stock comprising:

a hammer;

a magazine shaft for receiving a removable magazine;

a rod operatively coupled to, and movable with, the hammer, the rod extending into the stock such that an end of the rod is located within the stock;

an insert located within the stock;

a rotatable projection mounted within the insert and having a first position wherein the projection performs at least one of preventing and substantially limiting movement of the hammer and a second position wherein the hammer is movable without interference from the projection, wherein the insert comprises a first insert and the weapon further comprises a second insert, wherein the second insert performs at least one of preventing and substantially limiting movement of the rod, and wherein the first and second inserts are interchangeable.

58. A weapon as defined in claim 57 wherein the first insert is removed from the weapon and the second insert is located in the stock of the weapon during shipment or extended periods of non-use of the weapon.

59. A weapon as defined in claim 57 wherein the second insert is removed from the weapon and the first insert is located in the stock of the weapon when the weapon is to be used.

60. A weapon as defined in claim 57 wherein the second insert includes a blind hole that performs at least one of preventing and substantially limiting movement of the rod.

61. An automatic weapon having a stock comprising:

a hammer;

a magazine shaft for receiving a removable magazine;

a rod operatively coupled to, and movable with, the hammer, the rod extending into the stock such that an end of the rod is located within the stock;

an insert located within the stock;

a rotatable projection mounted within the insert and having a first position wherein the projection performs at least one of preventing and substantially limiting movement of the hammer and a second position wherein the hammer is movable without interference from the projection, wherein the projection comprises a locking bar, the locking bar is rotatable between the first and second positions, the locking bar has an axis of rotation, and the axis of rotation of the locking bar runs roughly parallel to a direction of firing of the weapon.

62. An automatic weapon having a stock comprising:

a hammer;

a magazine shaft for receiving a removable magazine;

a rod operatively coupled to, and movable with, the hammer, the rod extending into the stock such that an end of the rod is located within the stock;

an insert located within the stock;

a movable projection mounted within the insert and having a first position wherein the projection performs at least one of preventing and substantially limiting movement of the hammer and a second position wherein the hammer is movable without interference from the projection, and wherein the projection comprises a locking body, the locking body has an axis, the axis runs substantially parallel to the direction of firing of the weapon;

a detachable tool adapted to move the locking body between the first and second positions; and a removable cover for hiding the projection from view.

63. A weapon as defined in claim 62 wherein the removable magazine comprises the cover.

* * * * *